US011192368B2

(12) United States Patent
Wagner et al.

(10) Patent No.: US 11,192,368 B2
(45) Date of Patent: Dec. 7, 2021

(54) PREPARING A PRINTER CARTRIDGE FOR TRANSPORT

(71) Applicant: HEWLETT-PACKARD DEVELOPMENT COMPANY, L.P., Houston, TX (US)

(72) Inventors: Jeffrey Allen Wagner, Vancouver, WA (US); Sierra Lynn Triebe, Vancouver, WA (US); Maria Magdalena Martinez, Sant Cugat del Valles (ES); Ronald Albert Askeland, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 583 days.

(21) Appl. No.: 15/329,401

(22) PCT Filed: Jul. 30, 2014

(86) PCT No.: PCT/US2014/048838

§ 371 (c)(1),
(2) Date: Jan. 26, 2017

(87) PCT Pub. No.: WO2016/018290

PCT Pub. Date: Feb. 4, 2016

(65) Prior Publication Data

US 2017/0210128 A1 Jul. 27, 2017

(51) Int. Cl.

| | |
|---|---|
| ***B41J 2/14*** | (2006.01) |
| ***B41J 2/16*** | (2006.01) |
| ***B41J 2/175*** | (2006.01) |

(52) U.S. Cl.

CPC ..... *B41J 2/1433* (2013.01); *B41J 2/162* (2013.01); *B41J 2/1754* (2013.01);
(Continued)

(58) Field of Classification Search

CPC ..... B41J 2/16552; B41J 2/16535; B41J 2/16541; B41J 2/16538; B41J 2/1606; B41J 2/16585; B41J 2202/21

See application file for complete search history.

(56) References Cited

U.S. PATENT DOCUMENTS 4,148,041 A * 4/1979 Rosenstock ..... B41J 2/19 347/28
4,231,046 A * 10/1980 Aiba ..... B41J 2/16523 347/28

(Continued)

FOREIGN PATENT DOCUMENTS

| | | |
|---|---|---|
| DE | 4326564 | 2/1995 |
| FR | 2876316 | 4/2006 |

OTHER PUBLICATIONS

Paul Calvert, "Inkjet Printing for Materials and Devices", American Chemical Society, Jun. 12, 2001.

*Primary Examiner* — John Zimmermann
(74) *Attorney, Agent, or Firm* — HP Inc. Patent Department

(57) ABSTRACT

A method of preparing a printer cartridge for transport may comprise applying a volume of immiscible fluid to a nozzle bore of a printhead. A printer cartridge may comprise a volume of immiscible fluid deposited into a nozzle bore of a nozzle of the printhead and a layer of immiscible fluid applied over the nozzle bore opening. A printhead die may comprise a volume of immiscible fluid deposited into a nozzle bore of the die and a layer of immiscible fluid applied over the nozzle bore opening.

20 Claims, 3 Drawing Sheets

(52) U.S. Cl.
CPC ..... *B41J 2/17533* (2013.01); *B41J 2/17536* (2013.01); *B41J 2/17559* (2013.01)

(56) References Cited

U.S. PATENT DOCUMENTS 4,734,706 A 3/1988 Le et al.
5,136,310 A 8/1992 Drews
5,859,654 A * 1/1999 Radke ..... B41J 2/14024 156/319
5,886,718 A * 3/1999 Johnson ..... G01D 15/18 347/85
6,290,346 B1 * 9/2001 Santhanam ..... B41J 2/1752 347/86
6,317,573 B1 * 11/2001 Baker ..... G03G 21/1832 399/111
6,328,411 B1 * 12/2001 Taylor ..... B41J 2/16511 346/74.2
6,338,539 B1 * 1/2002 Kobayashi ..... B41J 2/16532 347/108
6,520,621 B1 * 2/2003 Eckard ..... B41J 2/16547 347/33
6,660,103 B1 * 12/2003 Johnston ..... B41J 2/16552 134/2
7,344,220 B2 * 3/2008 Moynihan ..... B41J 2/16552 347/28
7,600,853 B2 * 10/2009 Bensing ..... B41J 2/1433 347/28
8,465,121 B2 * 6/2013 Yamada ..... B41J 2/16526 347/33
8,596,769 B2 * 12/2013 Hibbard ..... B41J 2/1752 347/42
8,820,885 B2 * 9/2014 Hildebrand ..... B41J 2/16544 347/28
2002/0140763 A1 10/2002 Nelson et al.
2002/0171705 A1 * 11/2002 Rhoads ..... B41J 2/16538 347/28
2005/0057608 A1 3/2005 Kachi
2006/0152558 A1 7/2006 Hoisington
2007/0173602 A1 7/2007 Brinkman et al.
2008/0204510 A1 8/2008 Sakurai et al.
2008/0273069 A1 11/2008 Langford
2008/0312354 A1 12/2008 Krawezyk et al.
2009/0225134 A1 9/2009 Tsukada
2010/0149253 A1 6/2010 Kusunoki
2011/0310181 A1 12/2011 Curcio
2013/0278673 A1 10/2013 Takeuchi
2013/0284956 A1 10/2013 Kwon et al.

* cited by examiner

PREPARING A PRINTER CARTRIDGE FOR TRANSPORT

BACKGROUND

Inkjet printing devices comprise a printhead that includes a number of chambers. Each of these chambers includes an actuator that ejects an amount of fluid such as ink out of the chamber. The chamber is in fluid communication with a nozzle bore that ends in a nozzle orifice. The fluid is ejected out of the nozzle and onto a substrate to form an image

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
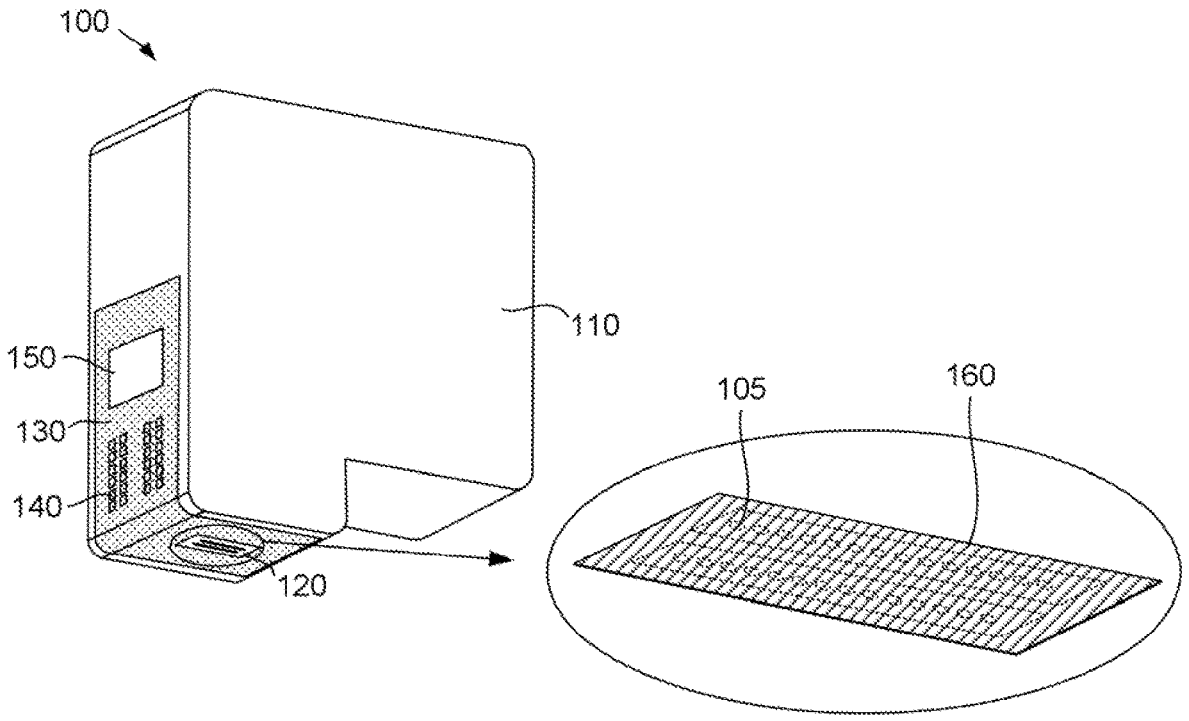
FIG. 1 is a block diagram of a printer cartridge as it may appear during shipping according to one example of the principles described herein.

A printhead may comprise a number of nozzles. In one example, the nozzles may be grouped on a plate member, sliver or a number of dies with each die having a number of nozzles defined therein. These nozzles form a path via a nozzle bore to a firing chamber where an amount of fluid is kept in preparation for ejection from the nozzle. The firing chamber comprises a firing mechanism by which an amount of ink is ejected out of the nozzle when fired. An example of a firing mechanism may be a piezoelectric material or a resistor. Printheads may be fluidly coupled to a fluid source with both the printhead and fluid source being incorporated into a single cartridge. Jettable fluid may be distributed to the individual firing chambers and nozzles in preparation for ejection of the jettable fluid onto a substrate.

Such cartridges are packaged and transported to individual stores for a user to purchase and insert into a printer. During transportation changes in the cartridge and jettable fluid might occur reducing the out of box experience for the purchaser. Specifically, fluids such as inks comprising pigments have a tendency to "settle." In this case, heavier pigment particles fall downwards and out of solution. If the cartridge were shipped with the print die and its nozzles facing down, this pigment can come out of solution and agglomerate in the nozzle bores. This may cause additional processes to be initiated when the cartridge is placed in the printer such as additional flushing processes, priming processes and other pre-printing maintenance. Even further, this may use up relatively large amounts of fluid in the cartridge reducing the life of the cartridge.

The present specification discloses a method of preparing a printer cartridge for transport comprising applying a volume of immiscible fluid to a nozzle bore of a printhead. In one example, the immiscible fluid is an isoparaffin such as Isopar L™.

The present specification further discloses a printer cartridge comprising a volume of immiscible fluid deposited into a nozzle bore of a nozzle of the printhead and a layer of immiscible fluid applied over the nozzle bore opening. In one example, the immiscible fluid is an isoparaffin such as Isopar L™.

The present specification also discloses a printhead die comprising a volume of immiscible fluid deposited into a nozzle bore of the die and a layer of immiscible fluid applied over the nozzle bore opening. In one example, the immiscible fluid is an isoparaffin such as Isopar L™.

As used in the present specification and in the appended claims, the term "fluid" is meant to be understood broadly as any substance that continually deforms under an applied shear stress. In one example, a fluid may be a pharmaceutical. In another example, the fluid may be an ink. In another example, the fluid may be a liquid.

Also, as used in the present specification and in the appended claims, the term "printer" is meant to be understood broadly as any device capable of selectively placing a fluid onto a substrate. In one example the printer is an inkjet printer. In another example, the printer is a three-dimensional printer. In yet another example, the printer is a digital titration device.

Even still further, as used in the present specification and in the appended claims, the term "a number of" or similar language is meant to be understood broadly as any positive number comprising 1 to infinity: zero not being a number, but the absence of a number.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

Turning now to the figures, FIG. 1 shows a printer cartridge as it may appear during shipping according to one example of the principles described herein. The cartridge (100) comprises a fluid reservoir (110), a die (120), a flexible cable (130), conductive pads (140), and a memory chip (150). The flexible cable (130) is adhered to two sides of the cartridge (100) and contains traces that electrically connect the memory (150) and die (120) with the conductive pads (140).

The cartridge (100) may be installed into a cradle that is integral to the carriage of a printer. When the cartridge (100) is correctly installed, the conductive pads (140) are pressed against corresponding electrical contacts in the cradle, allowing the printer to communicate with, and control the electrical functions of, the cartridge (100). For example, the conductive pads (140) allow the printer to access and write to the fluid-jet memory chip (150).

The memory chip (150) may contain a variety of information including the type of fluid cartridge, the kind of fluid contained in the cartridge, an estimate of the amount of fluid remaining in the fluid reservoir (110), calibration data, error information, and other data. In one example, the memory chip (140) may comprise information regarding when the cartridge (100) should be maintained. As described herein, the maintenance may comprise applying a layer of immiscible fluid to the surface of the die (120). The printer can take appropriate action based on the information contained in the cartridge memory (140), such as notifying the user if the fluid supply is low or altering printing routines to maintain image quality. The cartridge memory (140) is shown as a separate element that is distinct from the die (120). However, according to one example, the die (120) may contain the memory in addition to the physical elements for dispensing the ink.

To create an image, the printer moves the carriage containing the cartridge over a piece of print medium or other substrate. At appropriate times, the printer sends electrical signals to the fluid-jet cartridge (100) via the electrical contacts in the cradle. The electrical signals pass through the conductive pads (140) and are routed through the flexible cable (130) to the die (120). The die (120) then ejects a small droplet of fluid from the reservoir (110) onto the surface of the substrate. These droplets combine to form an image on the surface of the substrate.

The die (120) may comprise any number of nozzles (105) as shown in the detailed view of the die (120) shown in FIG. 1. In an example where the fluid is an ink, a first subset of nozzles (105) may eject a first color of ink while a second subset of nozzles (105) may eject a second color of ink. Additional groups of nozzles (105) may be reserved for additional colors of ink. Prior to shipping, an immiscible fluid (160) may be deposited onto the die (120), The immiscible fluid (160) may cover each nozzle (105) of the die (120) such that ambient air does not come in contact with the fluid located within the nozzles (105) or nozzle bore. In one example, the immiscible fluid (160) is deposited within and along the entire length of the nozzle bore. The immiscible fluid (160) may remain on the die (120) and within the nozzle bore throughout the delivery time and storage of the cartridge (100).

The immiscible fluid (160) may be formed such that the advantages described herein may be realized. In one example, the immiscible fluid (160) has a viscosity of 0.8 to 5 centipoise (cp) (0.01-0.05 $kg*m^{-1}*s^{-1}$). In another example, the immiscible fluid has a viscosity of 1 to 2 cp. In yet another example, the immiscible fluid has a viscosity of 1.5457 cp.

In one example, the surface tension is 18-35 mN/m. In yet another example, the immiscible fluid has a surface tension of 22-27 mN/m. In still another example, the surface tension is 25.1 mN/m. The surface tension of the immiscible fluid sufficiently wets the surface of the die (120). The immiscible fluid (160) may spread sufficiently over the die (120) but not be too far so as to subject any portion of the die (120) or the fluid in the cartridge (100) to exposure to ambient air and evaporation. The viscosity may also be low enough so as to not plug any of the nozzle bores before the eventual firing of fluid through the immiscible fluid layer.

In one example, the molecular weight of the immiscible fluid (160) is 130 to 300 g/mol. In another example, the immiscible fluid has a molecular weight of 165 to 177 g/mol. In yet one example, the molecular weight of the immiscible fluid is 171 g/mol.

In one example, the immiscible fluid is soluble to 200 part per million (ppm) in 20° Celsius water. In one example, the density of the immiscible fluid at 10° C. is 0.6 to 1.2 $g/cm^3$. In another example, the density of the immiscible fluid at 10° C. is 0.7 to 0.8 $g/cm^3$. In yet another example the density of the immiscible fluid at 15° C. is 0.779 $g/cm^3$.

In one example, the boiling point of the immiscible fluid is within environmental range while also being able to be ejected from the nozzle by, for example, a thermal-ink jet printer. In this example, the boiling point may be between 185 and 260° C. In another example, the boiling point of the immiscible fluid is between 188° C. to 192° C. In yet another example, the boiling point is 190° C.

In one example, the immiscible fluid is a paraffin liquid or an isoparaffin liquid such as Isopar™. In another example, the immiscible fluid may be Isopar™ J, Isopar™ K. Isopar™ L, Isopar™ M. Isopar™ P, polypropylene glycol (PPG), or combinations thereof. In one example, the immiscible fluid is Isopar™ L.

The immiscible fluid (160) is also formulated so that it does not react with the fluid of the cartridge (100) and present in the firing chambers connected to the nozzle bores and nozzles. Consequently, in the present specification and in the appended claims, the term "immiscible fluid" is meant to be understood broadly as any fluid that is incapable of mixing with another fluid. As such, in one example, the immiscible fluid forms a coating over the fluid present in the nozzle bore sealing the fluid in the immediate portions of the nozzle and nozzle bore interface. In another example, the characteristics of the immiscible fluid may allow the immiscible fluid to flow further into the nozzle bore and into the firing chamber. However, due to the surface tension properties of the immiscible fluid, the immiscible fluid will still form a seal over the fluid present in the firing chamber by adhering to the surface of the nozzle bore.

The immiscible fluid may be formatted such that it is also substantially non-evaporative or substantially nonvolatile such that it does not evaporate when subject to ambient air or temperatures. In one example, the immiscible fluid is less volatile as compared to the jettable fluid within the nozzles. In one example, the evaporation rate of the immiscible fluid is 6 with n-BuAc equal to 100.

Figure 2:
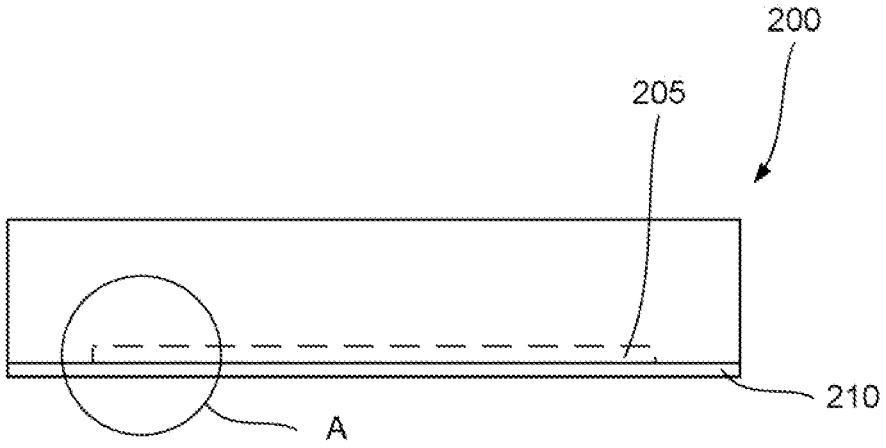
FIG. 2 is a side view block diagram of a printhead of a print cartridge according to one example of the principles described herein.

FIG. 2 is a side view block diagram of a printhead of a print cartridge according to one example of the principles described herein. The examples of the printhead (200) here also comprises a printhead die (205). In this example, the die (205) is flush with the rest of the body of the printhead (200). In another example, the die (205) is not flush with the rest of the body of the printhead (200) and may either be set into the body or protrude out of the body. As described above, a layer of immiscible fluid (210) is applied to the surface of the die (205), printhead (200) or combinations thereof. The application of the layer of immiscible fluid (210) to the die (205) covers the individual nozzles preventing the fluid inside the nozzle bores and ejection chambers from evaporating. In one example, the layer of immiscible fluid may be allowed to flow further into the nozzle bore, displacing and amount of fluid present in the nozzle bore. This may be accomplished by creating back pressure in the firing chambers associated with the nozzle bores thereby drawing in an amount of immiscible fluid. The thickness of the layer of immiscible fluid (210), in one example, may be 0.5 mm or less. In another example, the thickness of the layer of immiscible fluid (210) is 1 micron. In another example, the thickness of the immiscible fluid layer does not prevent the nozzle from being able to eject an amount of jettable fluid out of the nozzle. Consequently, in one example, the thickness of the layer of immiscible fluid is not too thick so as to prevent ejection of the jettable fluid.

As briefly described above. The immiscible fluid prevents the fluid in each nozzle from evaporating. The evaporation of the fluid leaves an amount of non-evaporative substance behind. The non-evaporative substance of the jettable fluid may subsequently block the path of any non-evaporated jettable fluid. As a consequence, the nozzle, nozzle bore, and firing chamber cannot eject an amount of jettable fluid thereby destroying its usefulness. The layer of immiscible fluid prevents this from happening during transportation and storage of the print cartridge (FIG. 1, 100).

Figure 3:
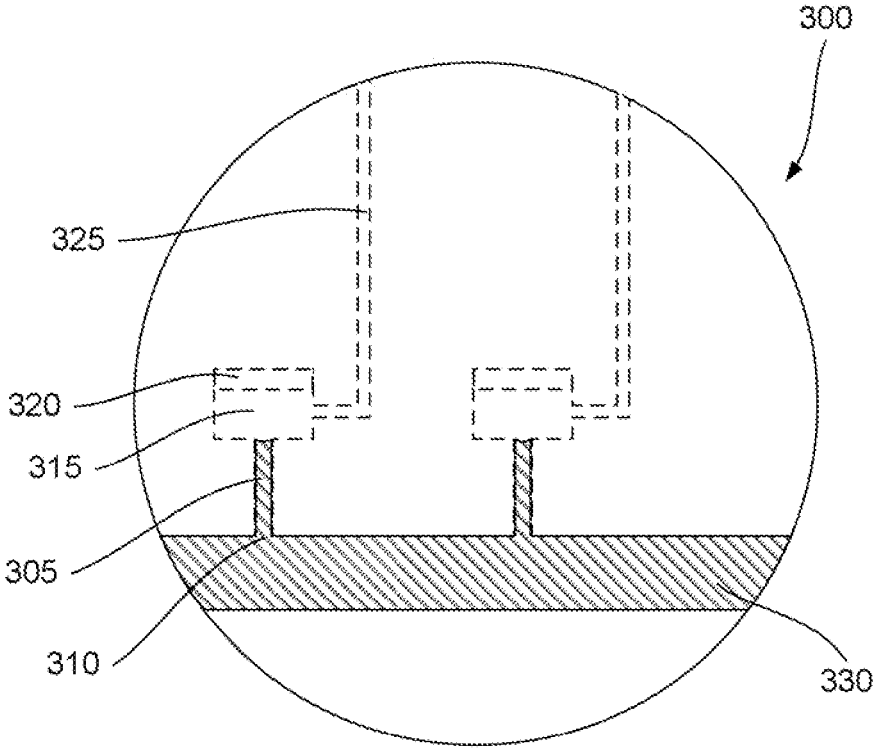
FIG. 3 is block diagram of the printhead of FIG. 2 showing a close up view of circle "A" shown in FIG. 2 according to one example of the principles described herein.

FIG. 2 further comprises a circle "A" FIG. 3 is block diagram of the printhead of FIG. 2 showing a close up view of circle "A" shown in FIG. 2 according to one example of the principles described herein. The internal components of the printhead (300) are shown with dashed lines. These internal components comprise a nozzle bore (305) that fluidly connects the nozzle (310) to the firing chamber (315). The firing chamber (315) comprises a firing mechanism (320). The firing mechanism (320), in one example, may be a thermal resistor. In this example the thermal resistor would be electronically connected to a printing device's electrical source such that, upon instructions from the printer's processor, an electrical charge is passed through the resistor causing the resistor to heat up. The relatively quick increase in temperature causes the fluid to boil and be ejected out of the nozzle (310). In another example the firing mechanism (320) may be a piezoelectric material that is also coupled to an electrical source of the printer. The piezoelectric material, upon application of a current, expands causing fluid in the chamber (315) to be ejected through the nozzle bore (305) and out of the nozzle (310).

The printhead (300) further comprises a fluid supply line (325) that couples a fluid reservoir (FIG. 1, 110) to the fluid chamber (315). During manufacture of the cartridge (FIG. 1, 100) the fluid is supplied to the fluid supply line (325), fluid chamber (315), nozzle bore (305) and nozzle (310). Before shipping and packaging of the fluid cartridge (FIG. 1, 100) a layer of immiscible fluid (330) is applied to the surface of the printhead (300). As this is done, the immiscible fluid (330) is also made to go into the nozzle bore (305). In the example shown here, the immiscible fluid is made to extend all the way through the nozzle bore (305). In other examples, the immiscible fluid can be present into the firing chamber (315) or any distance from the surface of the printhead (300) and into the nozzle bore (305).

As described above, during production of the fluid cartridge (FIG. 1, 100), the cartridge (FIG. 1, 100) is filled with a fluid. This fluid is distributed throughout the cartridge *(FIG. 1, 100) including through the number of fluid supply lines (325), the number of fluid chambers (315), the number of nozzle bores (305). When the fluid enters the nozzle bore (305), it may form a meniscus. After time, however, vibrations and other shipping events cause certain substances such as pigments to fall out of solution. Additionally, those vibrations and other shipping events may cause the meniscus to break allowing air to be ingested into the nozzle bore (305). Consequently, as air is allowed to enter the nozzle bore (305), fluid is forced out of the nozzles causing loss of fluid and spoiling of the print cartridge (FIG. 1, 100).

Figure 4:
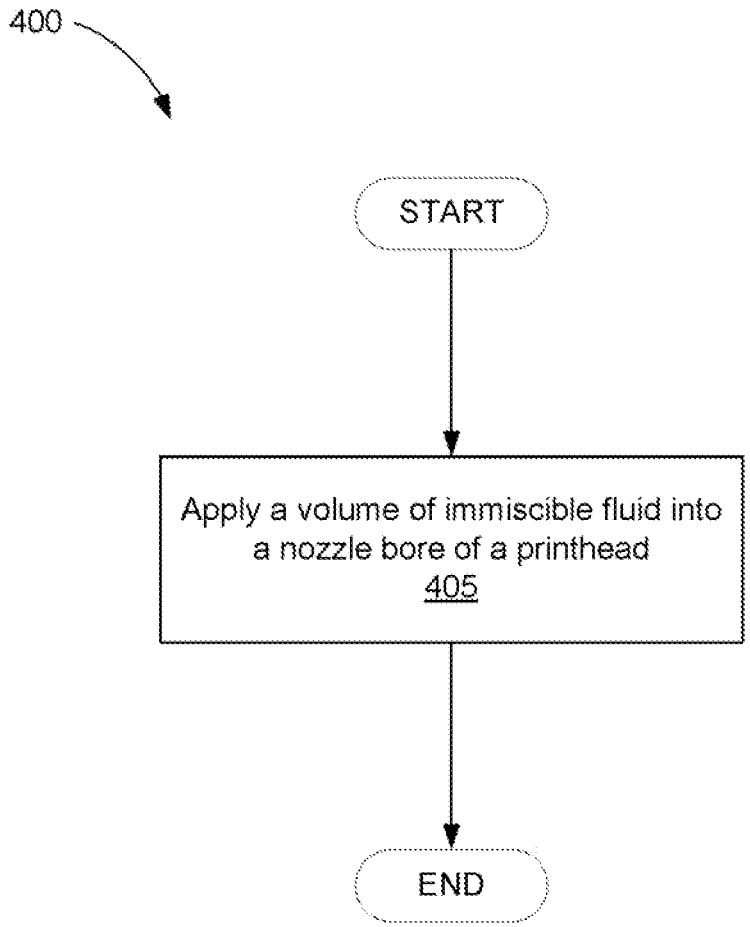
FIG. 4 is a flowchart showing a method of preparing a printer cartridge for transport according to one example of the principles described herein.

The presence of the immiscible fluid on the nozzles (310) and in the nozzle bores (305) provides a stronger seal or cap around the nozzles (310), as well as physically blocking the nozzle bore (305) from air coming in or fluid exiting. Specifically, because the meniscus cannot be broken, air cannot enter into the nozzle bore (305). Additionally, any particles that have come out of solution cannot subsequently block or coagulate within the nozzle bore (305). These advantages allow a cartridge to be transported and stored relatively longer periods of time without significant damage to the FIG. 4 is a flowchart showing a method (400) of a method (400) of preparing a printer cartridge for transport according to one example of the principles described herein. The method (400) may begin with applying (405) a volume of immiscible fluid into a nozzle bore (FIG. 3, 305) of a printhead (FIG. 1, 100). As described above, the printer cartridge (FIG. 1, 100) may comprise a number of dies into which a number of nozzles are defined. The nozzles are the terminal ends of the nozzle bores (FIG. 3, 305). The application (405) of the immiscible fluid into the nozzle bores (FIG. 3, 305) may be accomplished a number of ways. In one example, the immiscible fluid may be forced into the nozzle bores (FIG. 3, 305) from the surface of the printhead during the application of the immiscible fluid to the surface of the printhead. In this example, a measured amount of immiscible fluid may be pressed against the surface of the printhead within a closed system. The force of the immiscible fluid into the nozzle bores (FIG. 3, 305) would push any fluid in the nozzle bores (FIG. 3, 305) back into the fluid chamber (FIG. 3, 315). In an alternative example, the immiscible fluid may be forced into the nozzle bores (FIG. 3, 305) before the cartridge (FIG. 1, 100) is filled with fluid. In some examples the application (405) of the immiscible fluid may be accomplished by an immiscible fluid distribution system. The immiscible fluid distribution system may be a system that receives a fluid cartridge (FIG. 1, 100) and applies an amount of immiscible fluid to the surface of the printhead. In other examples of application (405) of immiscible fluid to the printhead, negative pressure may be applied to the conduits within the fluid cartridge (FIG. 1, 100) such that application of the negative pressure draws into the nozzle bores (FIG. 3, 305) an amount of immiscible fluid placed in contact with the surface of the printhead.

In one example, the method may continue with applying a layer of immiscible fluid over the openings of the nozzle bores (FIG. 3, 305). As described above the application of the layer of immiscible fluid may contribute to the capping or sealing the nozzle bores (FIG. 3, 305) and may further prevent ambient air from entering the nozzle bores (FIG. 3, 305). The application (410) of the layer of immiscible fluid may also be accomplished by a number of methods. In one example, the layer of immiscible fluid (FIG. 3, 330) may be applied by a roll on method using a number of rollers. In another example, the layer of immiscible fluid (FIG. 3, 330) may be applied by a spray on method. In yet another example, the layer of immiscible fluid may be applied (410) to the openings of the nozzle bores (FIG. 3, 305) through the use of a web-wipe and wiper: the web-wipe being impregnated with the immiscible liquid such that when the web-wipe is placed into contact with the nozzle plate of the printhead (140) the wiper squeegees out an amount of immiscible fluid onto the surface of the nozzle plate. In still another example, the layer of immiscible fluid may be applied (410) to the openings of the nozzle bores (FIG. 3, 305) through the use of wiper to spread or distribute an amount of immiscible fluid to the surface of the nozzle plate of the printhead.

The present method (400) may be accomplished through the use of a computer program product with the computer program product comprising a computer readable storage medium comprising computer usable program code embodied therewith. In this example, the computer usable program code may comprise computer usable program code to, when executed by a processor, cause an immiscible fluid distribution system to apply (FIG. 4, 405) a volume of immiscible fluid into a nozzle bore of a printer die. The computer usable program code may further comprise computer usable program code to, when executed by a processor, cause an immiscible fluid distribution system to apply (FIG. 4, 405) a layer of immiscible fluid over the nozzle bore opening.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via the processor of the computer or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a method of preparing a printer cartridge for transport. The method provides for applying an amount of immiscible fluid to a nozzle bore of a printer cartridge. Additionally, the method may comprise applying a layer of immiscible fluid to the surface of the printhead. This method may have a number of advantages, including preserving the functionality of the printhead and individual nozzles during transport and storage and before a purchaser uses the printer cartridge. As described above the vibrations and other shipping events may cause certain substances within the fluid contained in the printer cartridge to fall out of solution. When this occurs, the nozzle bores in the printhead may be permanently damaged due to the accumulation of the substances in the nozzle bore. Additionally, the jarring of the printer cartridge during transportation may cause the meniscus created by the fluid stored in the printer cartridge to fail allowing an amount of air into the cartridge. This may further cause leaking of the cartridge fluid as well. The placement of the immiscible fluid in the nozzle bores and on the printhead prevents both from occurring. Additionally, the present systems and methods described herein allow for a printhead or print cartridge to be shipped with an amount of fluid such as ink present in the firing chambers and nozzle bores instead of shipping a dry printhead for an end consumer to fill with the fluid. Consequently, both time and ink are saved such that setup of a printer for printing is quickened. The present systems and methods further provides for the printhead to be shipped without a specific fluid added to the ejectable fluid in the printhead thereby saving costs in additional materials and increasing the quality of any printings.

The preceding description has been presented to illustrate and describe examples of the principles described. This description is not intended to be exhaustive or to limit these principles to any precise form disclosed Many modifications and variations are possible in light of the above teaching.

What is claimed is:

1. A method of preparing a printer cartridge for transport, comprising:

in preparation for shipping and prior to installation of the printer cartridge in a printer, applying a volume of immiscible fluid to a nozzle bore of a printhead, wherein the immiscible fluid is immiscible, and does not react, with a fluid stored in the printer cartridge; and shipping the printer cartridge with the immiscible fluid in place.

2. The method of claim 1, comprising applying a volume of immiscible fluid into a nozzle bore of a printhead and applying a layer of immiscible fluid over a nozzle bore opening.

3. The method of claim 1, in which the immiscible fluid is an isoparaffin.

4. The method of claim 1, in which the immiscible fluid has a density of 0.6 to 1.2 g/cm$^3$.

5. The method of claim 1, in which the immiscible fluid has a molecular weight of 130 to 300 g/mol.

6. The method of claim 1, in which the immiscible fluid has a viscosity of 0.8 to 5 centipoise.

7. The method of claim 1, in which the immiscible fluid is water soluble to 200 ppm at a water temperature of 20° C.

8. The method of claim 1, in which the immiscible fluid has a surface tension of 18 to 35 mN/m.

9. A packaged printhead comprising:

the printhead;

packaging enclosing the printhead to protect the printhead during shipping and prior to installation in a printing device;

a volume of immiscible fluid deposited into a nozzle bore of a nozzle of the printhead; and a layer of immiscible fluid applied over a nozzle bore opening, wherein the immiscible fluid is immiscible, and does not react, with a fluid stored in the printhead.

10. The printhead of claim 9, in which the immiscible fluid has a viscosity of 0.8 to 5 centipoise.

11. The printhead of claim 9, in which the in which the immiscible fluid has a density of 0.6 to 1.2 g/cm$^3$.

12. The printhead of claim 9, in which the immiscible fluid has a surface tension of 18 to 35 mN/m.

13. The printhead of claim 9, in which the immiscible fluid has a molecular weight of 130 to 300 g/mol.

14. The printhead of claim 12, in which the immiscible fluid has a surface tension of 22 to 27 mN/m.

15. A printhead die comprising, at time the printhead die is completed by a manufacturer for shipping or storage:

a volume of immiscible fluid deposited into a nozzle bore of the die; and a layer of immiscible fluid applied over a nozzle bore opening, wherein the immiscible fluid is immiscible, and does not react, with a fluid dispensed by the printhead die, the immiscible fluid remaining present for shipping or storage.

16. The printhead die of claim 15, in which the immiscible fluid is an isoparaffin.

17. The method of claim 1, further comprising shipping the printer cartridge, prior to installation in a printer, with the immiscible fluid applied to the nozzle bore of the printhead.

18. The method of claim 1, wherein the immiscible fluid is made to extend all the way through the nozzle bore.

19. The method of claim 1, further comprising creating a back pressure in the nozzles of the printer cartridge to draw the immiscible fluid into the nozzle bore of the printhead.

20. The method of claim 1, further comprising forcing the immiscible fluid into the nozzle bore before the cartridge is filled with fluid.

* * * * *